US007284509B2

(12) United States Patent
Kochi et al.

(10) Patent No.: US 7,284,509 B2
(45) Date of Patent: Oct. 23, 2007

(54) FORCED-AIR-COOLED ENGINE WITH COOLING AIR GUIDE COVER

(75) Inventors: Hiroyoshi Kochi, Sagamihara (JP); Manabu Sekimukai, Sagamihara (JP); Yosuke Maruta, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/594,738

(22) Filed: Nov. 9, 2006

(65) Prior Publication Data

US 2007/0101951 A1 May 10, 2007

(30) Foreign Application Priority Data

Nov. 10, 2005 (JP) ..... 2005-325604

(51) Int. Cl.
*F01P 1/02* (2006.01)
*F01P 7/04* (2006.01)

(52) U.S. Cl. ..... 123/41.7; 123/41.65; 123/198 E

(58) Field of Classification Search ..... 123/198 E, 123/41.56, 41.63, 41.65, 41.7
See application file for complete search history.

(56) References Cited

U.S. PATENT DOCUMENTS 4,993,381 A * 2/1991 Absenger ..... 123/41.7
5,161,490 A 11/1992 Iwata et al.

FOREIGN PATENT DOCUMENTS

JP 61-33224 9/1986
JP 2691461 9/1997

* cited by examiner

*Primary Examiner*—Noah P. Kamen
(74) *Attorney, Agent, or Firm*—Wenderoth, Lind & Ponack, L.L.P.

(57) ABSTRACT

The invention provides a method and construction of vibration control supporting a cooling fan cover. In a forcer-air-cooled engine having a cooling fan cover fixed directly by means of fixing bolts to the cylinder block at fixing foot parts provided at a peripheral border of the fan cover, band-like vibration damping members are disposed between the peripheral border of the fan cover and the cylinder block in each region of the peripheral border belonging to each sector part defined between two adjacent fixing points of two adjacent fixing foot parts among said plurality of fixing foot parts respectively so that each of said damping members is pressed against the cylinder block by each region of the peripheral border when the bolts are tightened, said band-like damper members are flexible damping members each of which is disposed in an essential part of loop of vibration of the periphery for preventing generation of noise due to vibration of the fan cover with the fixing points as nodes of vibration resonating to cylinder block vibration, and said band-like flexible vibration damping members are adjusted thereby to adjust elastic force and damping capacity of the damping members so that resonance of the fan cover occurs at a rotation speed of engine higher than normal rotation speed thereof.

4 Claims, 4 Drawing Sheets

FORCED-AIR-COOLED ENGINE WITH COOLING AIR GUIDE COVER

BACKGROUND OF THE INVENTION

1. Field of the Invention

The present invention relates to a forced-air-cooled engine having a cylinder block which is composed in one piece with a crankcase part and a cylinder part, specifically to a vibration control supporting method and a vibration control supporting construction of a cooling fan cover which constitutes a casing for guiding cooling air to the cylinder block.

2. Description of the Related Art

The forced-air-cooled engine to which the present invention is applied is one having a crankshaft supported horizontally in the crankcase part of the cylinder block by a pair of bearings and having a cooling fan attached to an end side (opposite to an output shaft side) of the crankshaft. The cooling fan rotates with the crankshaft and produce cooling air flow which hits the cooling fins formed around the outer surface of the cylinder part protruding from the crankcase part radial direction of the crankshaft to cool the cylinder.

As the fan cover constituting the casing of the cooling fan is fixed to the cylinder block, the fan cover vibrates violently resonating to the vibration of the cylinder block, as a result, not only noise is generated but also loosening and dropping-out of adjacent parts are induced that often lead to trouble. Thus, forced-air-cooled engines have been faced with a problem of reduced reliability.

A variety of constructions to fix the fan casing to the cylinder block have been devised in the field of forced-air-cooling engines for preventing resonance with engine vibration. There are disclosed vibration isolation supporting between the fan cover and cylinder block in Japanese Patent No. 2691461 (hereafter referred to as patent literature 1) and Japanese Published Utility Model Application No. 61-33224 (hereafter referred to as patent literature 2).

Vibration control supporting are adopted in these disclosures is to attach the fan cover to the cylinder block by the medium of rubber grommets fit in a plurality of holes provided along the peripheral part of the fan cover and bolts passing through holes of the grommets so that the fan cover is supported elastically.

With the art, natural frequency of the fan cover can be lowered than frequencies of engine vibration occurring at normal rotation speed range of the engine by properly determining material and size of the rubber grommet and adjusting tightening force of the bolts. However, in this method, the fan cover is supported at a plurality of fixed positions elastically via the rubber grommets and bolts, so when unexpected force is transmitted to the fan cover from the cylinder block side or crankshaft side, the fan cover is moved from side to side and up and down, that is, the cooling fan cover is not stable against unexpected force.

Further, as a plurality of short cylindrical holes for fitting in rubber grommets must be formed by drawing along the peripheral part of the fan cover for receiving the rubber grommets, manufacturing process of the fan cover becomes complicated.

There is disclosed in Japanese Patent No. 3686202 (hereafter referred to as patent literature 3) another art of attaching a cooling air guide casing, which is not constructed such that the cooling air guide casing is fixed to the cylinder block at a plurality of fixing points positioned at certain spacing by means of bolts via rubber grommets to support the fan cover elastically, but in which two damper plates for insulating vibration are placed between the cylinder block and the cooling air guide casing along the peripheral border of the cooling fan casing for preventing amplification of engine vibration and noise thanks to vibration damping capacity of the damper plate. A concretive vibration control method is disclosed in said patent literature, in which the cooling air guide casing (cooling fan cover) is fixed to the cylinder block with two damper plates which are formed to serve as cooling air guide plates being disposed between the air guide casing and cylinder block in a state the damper plates are pressed against the cylinder block by the tightening force of a plurality of bolts.

With this art, when elasticity of the damper member and tightening force of the bolts are properly determined, transmission of vibration of the cylinder block to the cooling air guide casing is suppressed by virtue of vibration damping capacity of the damper member, and noise generation due to vibration, particularly resonance of the cooling air guide casing can be prevented.

However, it is not easy to machine with accuracy the concaved parts for receiving the damper plates to be of depth so that the damper plates are attached between the air guide sassing and the end face of the cylinder block with proper interference, or shrink of the damper plate made of synthetic resin when the air guide casing is fixed to the cylinder block, taking into consideration the elasticity of the synthetic resin material.

SUMMARY OF THE INVENTION

The present invention relates to a forced-air-cooled engine having a cylinder block which is composed in one piece with a crankcase part and a cylinder part, specifically to a vibration control supporting method and a vibration control supporting construction of a cooling fan cover which constitutes a casing for guiding cooling air to the cylinder block, and an object of the invention is to provide a vibration control supporting construction of a cooling fan cover for achieving effective vibration control of the cooling fan cover by combining a supporting construction of direct fixing and a supporting construction via vibration damping members, by which vibration characteristic of the fan cover can be adjusted properly with ease. In the case of supporting the fan cover via rubber grommets, it is necessary to prepare holes by drawing for fitting-in rubber grommets along the peripheral part of the fan cover at certain spacing exactly in order to fit the rubber grommets strictly to the fan cover and insert bolts into the holes of the rubber grommets to be screwed into corresponding screw holes provided on the cylinder block. Further, as to the diameter and length of the short cylindrical holes formed by drawing, dimensions are required to conform to the shell diameter and groove width of the rubber grommets, so considerably high technology of plate metal processing is required. Furthermore, it is necessary to adopt rubber grommets of proper size and hardness and to adjust tightening of the bolts in order to realize desired vibration control performance, which is troublesome business depending on variations in machining accuracy of constituent parts.

Further, in the case the cooling fan cover is supported at a plurality of fixing points by means of a plurality of rubber grommets, generally the natural frequency of the fan cover is lower is in a range of normal rotation speed of the engine, so, when extraordinary reactive rotational force (for example, reactive impact torque when the engine is stopped) is exerted on the fan cover, the fan cover often oscillates violently.

Furthermore, as multipurpose forced-air-cooled engines are used for various applications, the engine or the fan cover attached to the cylinder block of the engine often experiences unexpected force. Therefore, when supporting construction using rubber grommets is adopted, sustainment of the fan cover is often damaged. To solve the problem, it is necessary to provide a supporting construction of the cooling fan with which resonant vibration of the fan cover at normal engine rotation speed is evaded while the fan cover is fixed securely to the cylinder block.

Therefore, another object of the invention is to provide a vibration control supporting construction of the cooling fan cover while eliminating unstableness of the fan cover against unexpected force.

Farther object of the invention is to provide a compact supporting construction of the fan cover with which vibration of the fan cover can be suppressed effectively while fixing the peripheral border of the fan cover to the cylinder block by means of a plurality of bolts.

As the engine vibration is transmitted from the cylinder block to the fan cover at the fixing points, it is necessary to devise to mitigate the vibration transmitted form the cylinder block by means of damper members or elastic members and to evade resonance of the fan cover at normal engine rotation speed.

The present invention aims to solve the problems mentioned above by combining a supporting construction of the fan cover in which band-like vibration damper members are disposed between the peripheral border of the fan cover and the cylinder block and the damper members are pressed against the cylinder block by the peripheral border of the fan cover.

It is also necessary that complicated machining is not required for manufacturing pertinent parts for composing said construction, and that natural frequency of the fan cover can be adjusted with ease to be in a range higher than the frequency range of the cylinder block.

The present invention aims to solve the problems by following means.

The present invention proposes as a first means a method of vibration control supporting a cooling fan cover fixed directly by means of fixing bolts to a cylinder block of a forced-air-cooled engine at a plurality of fixing foot parts provided at a peripheral border of the fan cover, wherein said fixing foot parts are provided at certain spacing along rotation direction of the crankshaft, band-like vibration damping members are disposed between the peripheral border of the fan cover and the cylinder block in each region of the peripheral border belonging to each sector part defined between two adjacent fixing points of two adjacent fixing foot parts among said plurality of fixing foot parts respectively so that each of said damping members is pressed against the cylinder block by each region of the peripheral border when the bolts are tightened, thus two kinds of supporting constructions are combined, wherein said band-like damper members are flexible damping members each of which is disposed in an essential part of loop of vibration of the periphery for preventing generation of noise due to vibration of the fan cover with the fixing points as nodes of vibration resonating to cylinder block vibration, and wherein said band-like flexible vibration damping members are adjusted thereby to adjust elastic force and damping capacity of the damping members so that resonance of the fan cover occurs at a rotation speed of engine higher than normal rotation speed thereof.

The invention proposed as a second means a forced-air-cooled engine having a cooling fan cover fixed directly by means of fixing bolts to a cylinder block of a forced-air-cooled engine at a plurality of fixing foot parts provided at a peripheral border of the fan cover, wherein said fixing foot parts are provided at certain spacing along rotation direction of the crankshaft, band-like vibration damping members are disposed between the peripheral border of the fan cover and the cylinder block in each region of the peripheral border belonging to each sector part defined between two adjacent fixing points of two adjacent fixing foot parts among said plurality of fixing foot parts respectively so that each of said damping members is pressed against the cylinder block by each region of the peripheral border when the bolts are tightened, thus two kinds of supporting constructions are combined, wherein said band-like damper members are flexible damping members each of which is disposed in an essential part of loop of vibration of the periphery for preventing generation of noise due to vibration of the fan cover with the fixing points as nodes of vibration resonating to cylinder block vibration, and wherein said band-like flexible vibration damping members are adjusted thereby to adjust elastic force and damping capacity of the damping members so that resonance of the fan cover occurs at a rotation speed of engine higher than normal rotation speed thereof.

In this case, it is preferable, in a forced-air-cooled engine having a cooling fan cover fixed directly by means of fixing bolts to a cylinder block of a forced-air-cooled engine at a plurality of fixing foot parts provided at a peripheral border of the fan cover according to claim 2, that each of said band-like flexible vibration damper members has a T-shaped groove inside thereof for receiving the peripheral border part of the fan cover, the peripheral border has relieved portions where said damper members are fitted to, each of the relieved portions being recessed by a depth a little smaller than bottom wall thickness of T-shaped grove of the damper member, and the relieved portions of the peripheral border of the fan cover are formed into flange part of small width so that the damping members are retained positively and compression pressure exerted on the bottom face of the T-shaped groove of the damper member due to tightening force of the bolts and due to vibration of the cylinder block is reduced.

Further, it is preferable, in a forced-air-cooled engine according to claim 2, that each of said band-like vibration damper members is a prolonged flexible member and fitted to the peripheral border of the fan cover at each of said relieved portions provided at essential part of loop of vibration of the periphery of the fan cover, the damper member being elastic, having vibration damping capacity, and being able to be adjusted in an arbitrary length as necessary.

According to the invention of claim 1, a method of supporting cooling fan cover can be provided by which the fan cover can be secured positively and stably to the cylinder block and does not resonate to any of vibrations occurring on the cylinder block at normal engine rotation speed.

According to the invention of claim 2, 3, and 4, a cooling fan supporting construction can be provided with which the fan cover is stably secured to cylinder block, clearance between the peripheral border of the fan cover and the cylinder block is reduced to minimum thereby preventing leakage of cooling air as far as possible, the vibration damper members can be attached with ease to the peripheral border of the fan cover and retained there positively, and damping capacity of the damping members can be adjusted easily.

DETAILED DESCRIPTION OF THE PREFERRED EMBODIMENTS

A preferred embodiment of the present invention will now be detailed with reference to the accompanying drawings.

Figure 1:
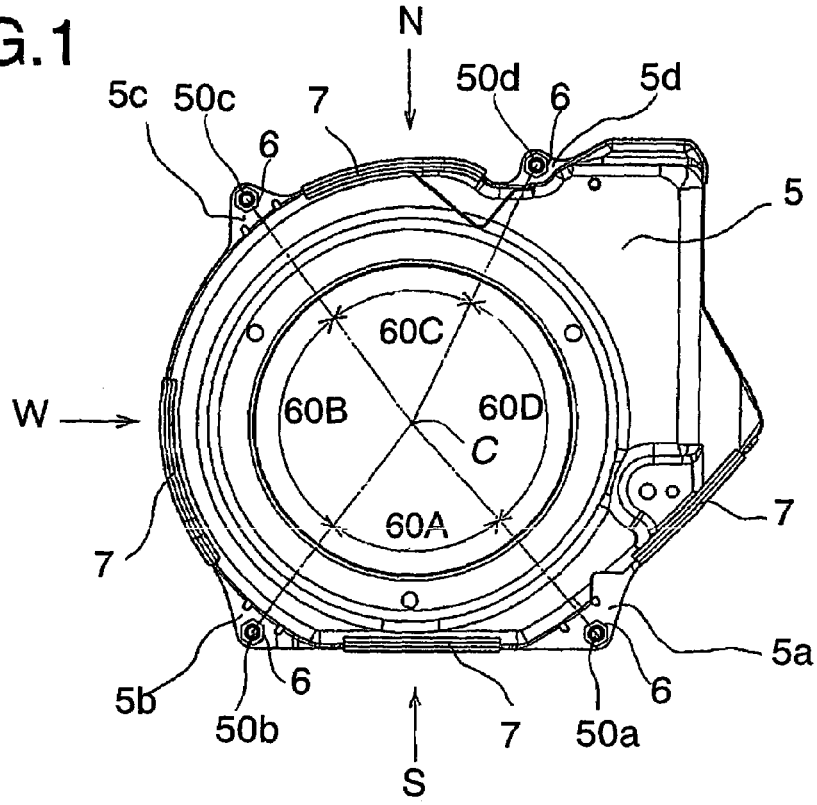
FIG. 1 is a rear view of the cooling fan cover to be applied to the forced-air-cooled engine adopting the vibration control supporting of the cooling fan cover of the present invention viewed from the cylinder block side of the engine, showing interior aspect thereof.
Figure 2:
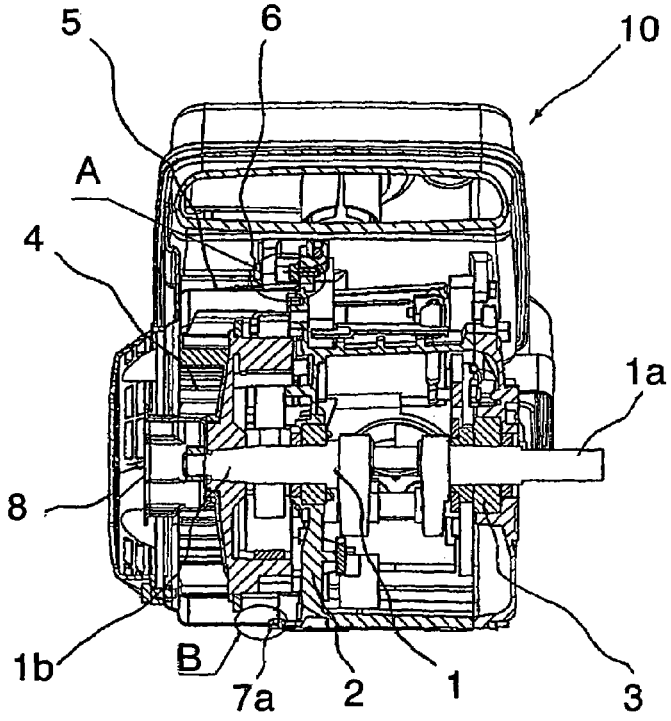
FIG. 2 is a longitudinal sectional view of the engine with the cooling fan cover of FIG. 1 attached to the cylinder block in front of the engine.
Figure 3:
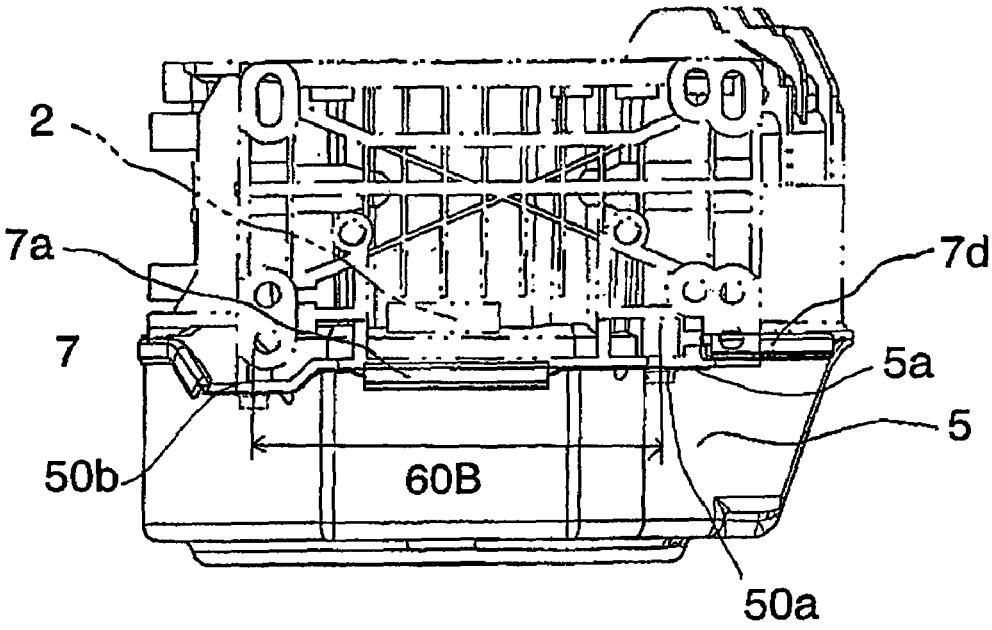
FIG. 3 is a bottom plan view of the cooling fan cover attached to the cylinder block and viewed in the direction of arrow S in FIG. 1.
Figure 4:
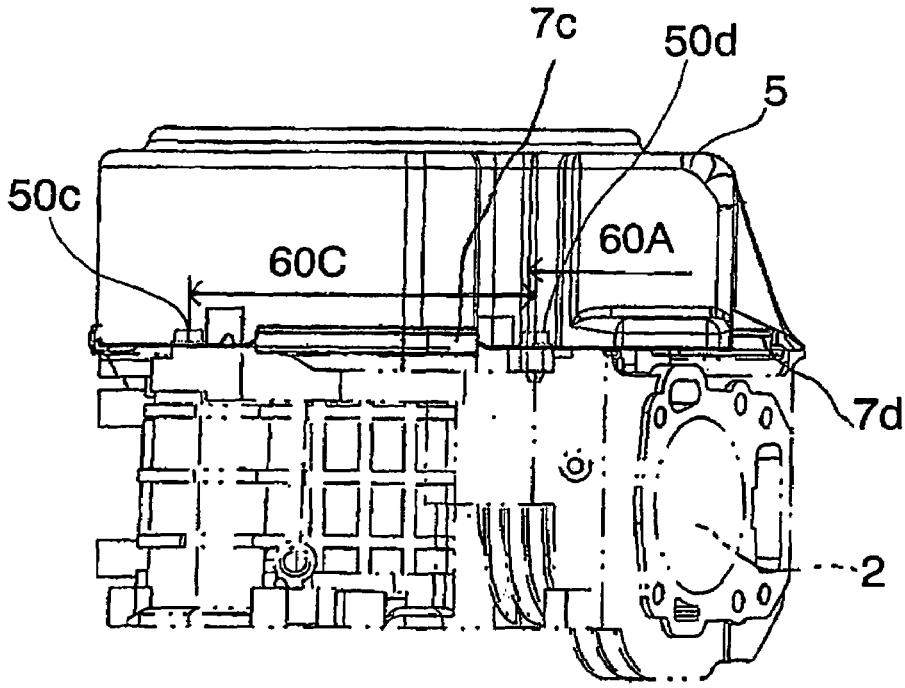
FIG. 4 is a top plan view of the cooling fan cover attached to the cylinder block and viewed in the direction of arrow N in FIG. 1.
Figure 5:
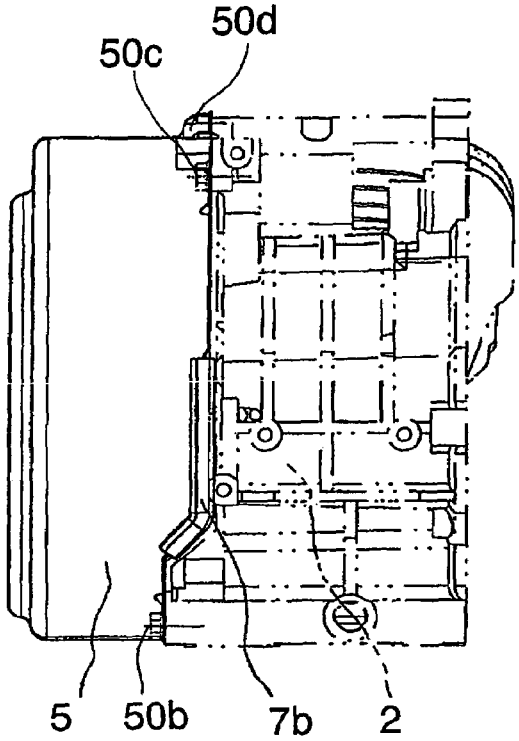
FIG. 5 is a side view of the cooling fan cover attached to the cylinder block and viewed in the direction of arrow W in FIG. 1.

FIG. 1 is a rear view of the cooling fan cover to be applied to the forced-air-cooled engine adopting the vibration control supporting of the cooling fan cover of the present invention viewed from the cylinder block side of the engine, showing interior aspect thereof. FIG. 2 is a longitudinal sectional view of the engine with the cooling fan cover of FIG. 1 attached to the cylinder block in front of the engine. FIG. 3 is a bottom plan view of the cooling fan cover attached to the cylinder block and viewed in the direction of arrow S in FIG. 1, FIG. 4 is a top plan view of the cooling fan cover attached to the cylinder block and viewed in the direction of arrow N in FIG. 1, and FIG. 5 is a side view of the cooling fan cover attached to the cylinder block and viewed in the direction of arrow W in FIG. 1, with the cylinder block depicted with chain lines.

Figure 6:
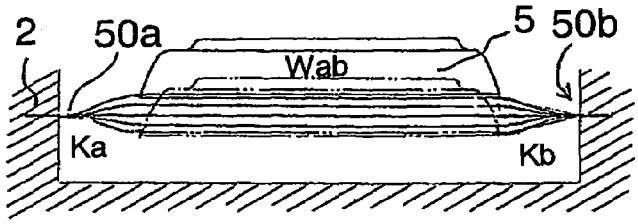
FIG. 6 is a representation of a vibration model of a part of the cooling fan cover when the present invention is not applied.

In FIG. 6 is represented a vibration model of a part of the cooling fan cover when the present invention is not applied for easy understanding the state of resonant vibration of the part of the cooling fan cover.

Figure 7:
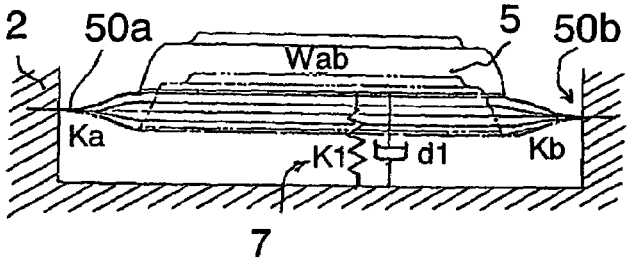
FIG. 7 is a representation of a vibration model of a part of the cooling fan when the present invention is applied.

In FIG. 7 is represented a vibration model of the same part as that of FIG. 6 of the cooling fan when the present invention is applied for easy understanding how vibration condition changes from that of FIG. 6 in which the present invention is not applied.

Figure 8:
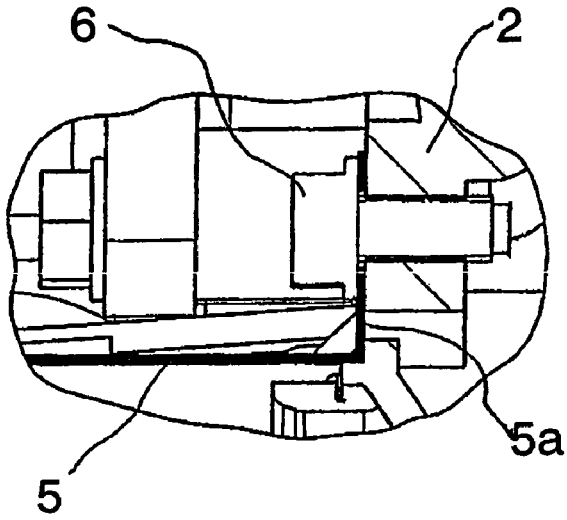
FIG. 8 is an enlarged detailed sectional view of part A in FIG. 2, where the cooling fan cover is fixed directly to the cylinder block by means of a bolt to fix the cooling cover.
Figure 9:
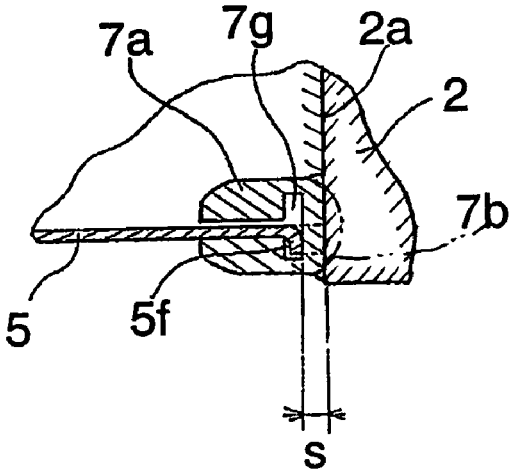
FIG. 9 is an enlarged detailed sectional view of part B in FIG. 2, where the band-like flexible vibration damper member is disposed between the peripheral border of the cooling fan cover and the cylinder block and pressed against the cylinder block by tightening force of bolts to fix the cooling fan cover so that the vibration of the cooling cover is controlled.

FIG. 8 is an enlarged detailed sectional view of part A in FIG. 2, where the cooling fan cover is fixed directly to the cylinder block by means of a bolt to fix the cooling cover, and FIG. 9 is an enlarged detailed sectional view of part B in FIG. 2, where the band-like flexible vibration damper member is disposed between the peripheral border of the cooling fan cover and the cylinder block and pressed against the cylinder block by tightening force of bolts to fix the cooling fan cover so that the vibration of the cooling cover is controlled.

In FIG. 2 showing longitudinal section of the forced-air-cooled engine 10 to which the present invention is applied, a crankshaft 1 is supported horizontally by a pair of bearings 3, 3 in a crankcase part 20 of a cylinder block 2. A cooling fan rotor 4 serves as a flywheel with fan blades formed on the outer periphery is fixed to the crankshaft 1 at an end (opposite side end of the output side 1*b*) thereof in front of the crankcase part 20. A cooling fan cover 5 surrounds the cooling fan rotor 4 to guide cooling air to the cylinder part.

The cooling fan rotor 4 rotates with the rotation of the crankshaft 1 and generates cooling air flow which hits a cylinder part 25 extending in radial direction of the crankshaft form the crankcase part 20 and cooling fins protruding from the outer periphery of the cylinder part 25 and cools the cylinder part 25.

The cooling fan cover 5 is fixed to the cylinder block at a plurality of fixing points 50*a*-50*d* on fixing foot parts 5*a*-5*d* provided at certain spacing along the peripheral border of the fan cover 5 by means of fixing bolts 6 (see FIG. 8 showing part A in FIG. 2). The cooling fan cover 5 is also fixed to the cylinder block via band-like vibration damping members 7*a*-7*d* by pressing the damping members against the end face of the cylinder block with peripheral border of the cooling fan cover 5. That is, the peripheral border of the fan cover is recessed in portions of the peripheral border between the fixing foot parts 5*a*-5*d* and the damper members 7*a*-7*d* are retained in the recessed parts.

In the embodiment, band-like vibration damper members 7*a*-7*d* are disposed between the peripheral border of the cooling fan cover 5 (rear side, i.e. cylinder block side edge of the outer periphery plate of the cooling fan) and the cylinder block 2.

Four sector parts 60A-60D of the fan cover. i.e. four domains of spreading, the peripheral border of each of which has parts fixed to the cylinder block 2 directly contacting the end face 2*b* of the cylinder block 2 and a part pressed against the end face 2*b* of the cylinder block 2 via the band-like vibration damper member 7*a*-7*d* made of flexible synthetic resin (as to the part pressing the damper member, see FIG. 9). Reference numeral 8 is a recoil starter cover.

FIG. 1 shows the interior aspect of the fan cover with all of the band-like flexible damper members 7*a*-7*d* being fitted to the peripheral border of the cooling fan cover 5. By investigating vibration mode of the fan cover 5 when it vibrates violently in sympathetic vibration with the vibration of the forced-air-cooled engine 10 in the state the band-like damper members 7*a*-7*d* are not fitted in to the fan cover in the one hand, and investigating vibration mode of the fan cover 5 when the band-like vibration damper member made of flexible synthetic resin 7*a*-7*d* are fitted on the other hand, it can be ascertained that natural frequency of the fan cover is shift to higher range than the engine vibration when the band-like flexible damper members are fitted.

How resonance of the fan cover can be evaded will be explained hereunder.

First, it is necessary to clarify the vibration of the sector part 60A of the fan cover 5, the sector part being assumed such that the center C of the central circular opening 55 of the fan cover is its pivotal point and the fixing points 50*a* and 50*b* at which fixed to the cylinder block by means of bolts 6, . . . are its outer edges.

Similarly, by investigating the vibration of the sector part 60B with the fixing points 50*b* and 50*c* being assumed to be its outer edges, the vibration of the sector part 60C with the fixing points 50*c* and 50*d* being assumed to be its outer edges, and the vibration of the sector part 60D with the fixing points 50*d* and 50*a* being assumed to be its outer edges, and by studying composite vibration of those of four sector parts 60A-60D, the vibration mode of the whole of the fan cover near resonant frequency can be clarified.

Therefore, a vibration model of the sector part 60A of the fan cover 5 in FIG. 3 with the fixing points 50*a* and 50*b* being assumed to be its outer edges is supposed as shown in FIG. 7, in which equivalent mass of the sector is assumed to be Wab, the bend elastic constant of the plate part spreading between the fixing points 50*a* and 50*b* is assumed to be Ka and Kb respectively, the modulus of longitudinal elasticity of the band-like vibration damper member 7 made of synthetic resin is K1, and its damping coefficient is d1.

First, in the case the fan cover to which the present invention is not applied, the band-like vibration damper member 7 made of synthetic resin does not exist, so the vibration model is as shown in FIG. 6 with the modulus of longitudinal elasticity K1 and the damping coefficient d1 removed from the vibration model shown in FIG. 7. In the case of the model of FIG. 6, total elasticity is smaller than that in the case of FIG. 7, and natural frequency is lower for the same equivalent mass Wab than that in the case of FIG. 7.

This means that even if the vibration model of FIG. 6 resonates with engine vibration, natural frequency of the vibration model of FIG. 7, which is the vibration model of the sector part 60A of the cooling fan cover according to the present invention, is higher than natural frequency of the model of FIG. 6, i.e. is in a range outside the resonant range of the model of FIG. 6.

Similarly, as to the sector part 60C of the fan cover 5 shown in FIG. 4 in a side view with the fixing points 50*c* and 50*d* being assumed to be its outer edges, natural frequency of the vibration model of the sector part 50C of the fan cover 5 is in a range outside the resonant range of the model of FIG. 6 by the action of equivalent mass Wcd of the sector part 60C, the bend elastic constants Kc and Kd of plate part, and the modulus of longitudinal elasticity K3 and damping coefficient d1 of the band-like vibration damper member 7 made of synthetic resin.

As the same argument can be applied to the sector part B and 60D, it is concluded that natural frequency of composite vibration of the sectors 60A-60B is in a range outside the resonant range of the model of FIG. 6, and stable support of the cooling fan cover 5 can be realized.

To what extent the natural frequency of each sector part should be increased above the resonant range of the model of FIG. 6 is determined by experiments with which to find out conditions the composite vibration is reduced most and the most stable support of the fan cover is realized. For this, it is important that application length and position of the band-like vibration damper member 7 can be adjusted.

In the invention, the band-like vibration damper member 7 is formed of flexible synthetic resin to have a uniform cross section which can be adjusted easily in length by cutting with a usual cutter.

As shown in FIG. 9, flange parts 5*f* of small width are formed near loops, or antinodes of vibration of each of the sector parts of the fan cover along the peripheral border thereof. The band-like damper member 7*a* can be adjusted in length within the range of length of the flange part 5*f* along the rear side edge of the peripheral part of the fan cover. Relief distance S is secured between the end faces of the flange parts 5*f* and the cylinder block 2 so that the end faces do not contact the end face 2*a* of the cylinder block when the fan cover 5 is fixed to the cylinder block by means of bolts 6. The band-like vibration damper member 7*a* made of synthetic resin is formed to have a groove 7*g* of the general shape of a letter T laid sideways inside thereof. The band-like vibration damper member 7*a* is fitted to the fan cover 5 allowing the peripheral border of the fan cover 5 having the flange part 5*f* of small width to be inserted into the T-shaped groove 7*g* of the band-like damper member 7*a*. Said relief distance s must be a little smaller than the thickness of the bottom wall of the T-shaped groove of the band-like damper member 7*a*, i.e. the distance from the bottom of the T-shaped groove 7*g* of the damper member 7*a* to the end face thereof to be brought into contact with the end face 2*a* of the cylinder block against the bottom face of the T-shaped groove 7*a* of the damper member 7 when the fan cover 5 is fixed completely by tightening the bolts 6. FIG. 9 shows this state in partial section. In this state, compression pressure is applied to the bottom face of the T-shaped groove 7*a* by the end face of the flange part 5*f* of the fan cover 5.

Further, when the engine is operated, compression pressure exerting on the bottom face of the T-shaped groove of the damper member 7 becomes fairly high due to vibration of the end face 2*b* of the cylinder block 2, so the small width of the flange part 5*f* must be large enough to an extent that the compression pressure exerting from the end face of the flange part 5*f* to the bottom face of the T-shaped groove 7*a* of the band-like damper member 7*a* is reasonable and proper for the material of the damper member 7*a* in order that the flange part is held in the damper member 7*a* while pressed against the damper member 7*a* with proper pressure. That the groove 7*a* is formed into T-shape in cross section is for the sake of making it easy to fit in the peripheral border part of the fan cover 5 to the groove 7*g* of the band-like damper member 7*a* by forming the groove 7*g* in a symmetrical shape.

Above explanation for the band-like damper member 7*a* is the same for the band-like damper member 7*b*-7*d*.

The fan cover is fixed securely to the cylinder block by a plurality of bolts at the fixing points 50*a*-50*d* of the foot parts 5*a*-5*d* provided at peripheral part of the fan cover and the fixing points 50*a*-50*d* become nodes of vibration of the sector parts 60A-60D. Each of the foot parts 5*a*-5*d* is a flat plate protruding like a tongue from the peripheral border of the pan-like cooling fan cover 5 having a central circular opening as shown in FIG. 1, so there remain bend elasticity in the foot parts even when the foot parts are fixed by bolts to the cylinder block and vibration of peripheral part of the fan cover is possible with the positions fixed by a pair of bolts as nodes of vibration.

It is thought that composite vibration, which is a synthesis of vibrations of each sector part occurring between each pair of fixing points, occurs in the domain extending radially inwardly from the outer periphery of the fan cover, so by controlling the vibration of the fan cover between each pair of the fixing points, vibration of the fan cover is controlled totally.

The periphery plate of the fan cover extending along rotation direction of the crankshaft vibrates with the fixing points as vibration nodes (see vibration model of FIG. 6). By composing such that, each of the band-like vibration damper members is provided between the peripheral border of the fan cover and the cylinder block in an essential part of loop of vibration of the periphery plate, and each of the band-like flexible vibration damper member is pressed against the cylinder block by the peripheral border of the fan cover, elasticity and vibration damping capacity for each equivalent mass of each part of the fan cover is increased (see vibration model of FIG. 7 according to the invention), and natural frequency of each part of the fan cover of the same equivalent mass can be increased, as a result, natural frequency of total fan cover as synthesis of natural frequency of each part can be increased.

Therefore, even if natural frequency of the fan cover without the band-like flexible vibration damper members being fitted thereto coincides with the frequency of normal rotation speed of the engine and resonant vibration of the fan cover occurs, the resonant vibration can be evaded, by fitting the flexible vibration damper members to the peripheral border of the fan cover between the fixing points thereof and constituting the construction in which the band-like flexible damper members are disposed between the peripheral border of the fan cover and the cylinder block and pressed against the cylinder block by the fan cover, because of increased natural frequency of the fan cover owing to the construction.

Further, by varying the length of the damper member having uniform cross section attached to the fan cover to extend along the peripheral border of the fan cover, the elastic force exerting to the fan cover from the band-like damper member and vibration damping capacity can be varied.

A T-shaped groove of width about the same to the thickness of the fan cover plate is provided inside the band-like vibration damper member, and the peripheral border of the fan cover is formed into a flange part of small width, in order that the damper member can be retained stably to the fan cover at the peripheral border thereof, and that total compression pressure exerting on the damper member due to tightening force of bolts to fix the fan cover to the cylinder block and due to engine vibration does not exceed permissible compression pressure of the material of the flexible damper member. The flange part is received in one side of the top part of the T-shaped groove, so the damper member can be retained stably to the fan cover.

In order to reduce cooling air leakage through the gap between the peripheral border of the fan cover and the end face of the cylinder block, it is suitable to form the peripheral border of the fan cover such that a part of the peripheral border where the damper member is fitted is relieved, or recessed by a depth which is a little smaller than the bottom wall thickness of the T-shaped groove of the damper member and the other part is recessed by a depth smaller than the depth of the recess where the damper member is fitted to so that said other part of the peripheral border of the fan cover does not contact the end face of the cylinder block, keeping a minimum clearance between the end face of the cylinder block even when the fixing bolts are tightened and the peripheral border of the fan cover presses the damper member against the cylinder block.

The band-like vibration damper member is an elongated, elastic member of oblong cross section having a T-shaped groove inside thereof for clasping the peripheral border part of the fan cover. The damper member has vibration damping capacity and can be cut by a usual cutter to be of an arbitrary length as necessary.

What is claimed is:

1. A method of vibration control supporting a cooling fan cover fixed directly by means of fixing bolts to a cylinder block of a forced-air-cooled engine at a plurality of fixing foot parts provided at a peripheral border of the fan cover, wherein said fixing foot parts are provided at certain spacing along rotation direction of the crankshaft, band-like vibration damping members are disposed between the peripheral border of the fan cover and the cylinder block in each region of the peripheral border belonging to each sector part defined between two adjacent fixing points of two adjacent fixing foot parts among said plurality of fixing foot parts respectively so that each of said damping members is pressed against the cylinder block by each region of the peripheral border when the bolts are tightened, thus two kinds of supporting constructions are combined, wherein said band-like damper members are flexible damping members each of which is disposed in an essential part of loop of vibration of the periphery for preventing generation of noise due to vibration of the fan cover with the fixing points as nodes of vibration resonating to cylinder block vibration, and wherein said band-like flexible vibration damping members are adjusted thereby to adjust elastic force and damping capacity of the damping members so that resonance of the fan cover occurs at a rotation speed of engine higher than normal rotation speed thereof.

2. A forced-air-cooled engine having a cooling fan cover fixed directly by means of fixing bolts to a cylinder block of a forced-air-cooled engine at a plurality of fixing foot parts provided at a peripheral border of the fan cover, wherein said fixing foot parts are provided at certain spacing along rotation direction of the crankshaft, band-like vibration damping members are disposed between the peripheral border of the fan cover and the cylinder block in each region of the peripheral border belonging to each sector part defined between two adjacent fixing points of two adjacent fixing foot parts among said plurality of fixing foot parts respectively so that each of said damping members is pressed against the cylinder block by each region of the peripheral border when the bolts are tightened, thus two kinds of supporting constructions are combined, wherein said band-like damper members are flexible damping members each of which is disposed in an essential part of loop of vibration of the periphery for preventing generation of noise due to vibration of the fan cover with the fixing points as nodes of vibration resonating to cylinder block vibration, and wherein said band-like flexible vibration damping members are adjusted thereby to adjust elastic force and damping capacity of the damping members so that resonance of the fan cover occurs at a rotation speed of engine higher than normal rotation speed thereof.

3. A forced-air-cooled engine according to claim 2, wherein each of said band-like flexible vibration damper members has a T-shaped groove inside thereof for receiving the peripheral border part of the fan cover, the peripheral border has relieved portions where said damper members are fitted to, each of the relieved portions being recessed by a depth slightly smaller than bottom wall thickness of T-shaped grove of the damper member, and the relieved portions of the peripheral border of the fan cover are formed into flange part of small width so that the damping members are retained positively and compression pressure exerted on the bottom face of the T-shaped groove of the damper member and due to vibration of the cylinder block is reduced.

4. A forced-air-cooled engine according to claim 2, wherein each of said band-like vibration damper members has a T-shaped grove inside thereof, being a prolonged flexible member and being fitted to the peripheral border of the fan cover at each of said relieved portions provided at essential part of loop of vibration of the periphery of the fan cover, the damper member being elastic, having vibration damping capacity, and being able to be adjusted in an arbitrary length as necessary.

* * * * *